United States Patent [19]

Era et al.

[11] Patent Number: 4,854,976

[45] Date of Patent: Aug. 8, 1989

[54] METHOD OF PRODUCING A MULTI-PHASE STRUCTURED COLD ROLLED HIGH-TENSILE STEEL SHEET

[75] Inventors: Hidenori Era, Izuka; Mineo Shimizu, Munakata, both of Japan; Huang-Chuan Chen, Hsiao-Kang, Taiwan

[73] Assignee: China Steel Corporation, Kaohsiung, Taiwan

[21] Appl. No.: 218,809

[22] Filed: Jul. 13, 1988

[51] Int. Cl.[4] ..... C21D 7/00

[52] U.S. Cl. ..... 148/2; 148/12 F

[58] Field of Search ..... 148/320, 12 F, 12 R, 148/2; 420/87

[56] References Cited

FOREIGN PATENT DOCUMENTS 57-137452 8/1982 Japan ..... 148/320

61-276928 12/1986 Japan ..... 148/12 F

*Primary Examiner*—Deborah Yee

*Attorney, Agent, or Firm*—Ladas & Parry

[57] ABSTRACT

A steel composition consists of 0.08–0.25% by weight of carbon, 0.3–2.0% by weight of silicon, 0.6–1.8% by weight of manganese, 0.04–0.20% by weight of phosphorus, less than 0.10% by weight of aluminum, less than 0.01% by weight of boron if necessary, unavoidable impurities and balance iron. The composition is subjected to hot rolling under the condition that the coiling temperature is less than 600 deg C. and cold rolling. The cold rolled steel is heated for 1–10 min at a temperature (Acl +10) deg C. to Ac3-10) deg C., then cooled at a rate greater than 50 deg C./sec up to a temperature 350–500 deg C. with a holding period of 1–10 min at that temperature before final air cooling. The microstructure of the cold rolled annealed steel has ferrite, martensite and retained austenite, the percentage of the retained austenite being more than 8%, and the steel has a tensile strength of 70kgf/sq.mm and the value of the product of the elongation and the tensile strength is greater than 2400kgf/sq.mm %.

1 Claim, 5 Drawing Sheets

Figure 1:
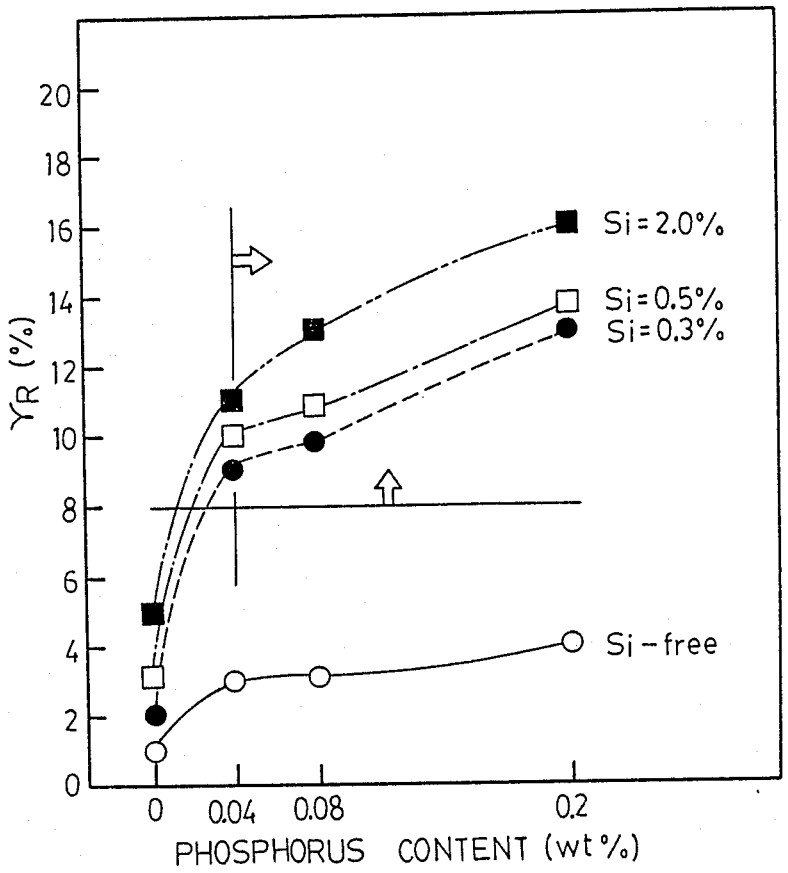

METHOD OF PRODUCING A MULTI-PHASE STRUCTURED COLD ROLLED HIGH-TENSILE STEEL SHEET

BACKGROUND OF THE INVENTION

This invention relates to a cold rolled steel having high strength and excellent ductility and formability.

Cold rolled steels are used extensively in sheet applications for automotive industries. Although a low carbon cold rolled steel has excellent formability, its low strength requires thick sections for load-bearing applications. New compositions with new processes have been developed to improve the strength of low carbon cold rolled steels and to reduce the weight of vehicle. Currently, high strength cold rolled steels with a strength of 45 to 70 kgf/sq.mm have been available in automobile industries in sheets that are 0.8–1.6mm thick.

For the safety of the riders and for reducing the weight of the vehicle, still higher strength (i.e. over 70kfg/sq.mm) of a cold rolled steel is necessary for use in sections of automobiles, the bumper and the reinforced beam inside the doors. There are many kinds of cold rolled steel sheets such as solid solution hardening steel, precipitation hardening steel, recovered steel, dual phase steel and full martensite steel, which have been developed to improve strength. However, the ductility in these steels gets worse as the tensile strength increases.

In Transaction ISIJ Vol.27, (1987), Osamu Matsumura, Yasuharu Sakuma and Hiroshi Takechi describe a steel which consists of 0.4% of C, 1.5% of Si and 0.8% Mn and which is subjected to an intercritical annealing after it is hot rolled and then cold rolled. The intercritical annealing is performed by heating the steel to a temperature of ferrite-austenite phase, then cooling it to the bainite transformation temperature region followed by holding for a suitable time before air cooling. A composite structure having ferrite, the retained austenite and bainite or a little amount of martensite is obtained by this process. Because this steel contains a large amount of retained austenite, a good combination of strength and ductility is obtained through the effect of TRIP, (transformation induced plasticity). Although this steel exhibits high strength and high ductility, the weldability thereof is still unsatisfactory due to the carbon content of 0.4% by weight which is greater than an appropriate weldable carbon content.

U.S. Pat. No. 4,561,910 discloses a hot rolled steel which consists of a steel having a composition consisting of 0.03–0.15 % by weight of C, 0.6–1.8% by weight of Mn, 0.04 –0.2% by weight of P, not more than 0.10% of Al, not more than 0.008% by weight of S and unavoidable impurities. This steel is hot rolled under a condition that the heating temperature is kept at 1,10–1,250 deg C., the finishing hot rolling temperature is kept to 800–900 deg C., the cooling rate from beginning of cooling following to hot rolling to coiling is kept to 10–100 deg C./sec. The resulting hot rolled steel sheet has a microstructure consisting of ferrite and martensite dispersed therein, the area fraction of the ferrite is at least 70% and that of the martensite is at least 5% at that section of the steel sheet. The steel sheet has a yield ratio of not higher than 70%, a yield strength of at least 30 kgf/sq.mm and a tensile strength of at least 50 kgf/sq.mm.

SUMMARY OF THE INVENTION

An object of the invention is to provide a high strength cold rolled steel which has a higher degree of formability and weldability than the steel described in the above-mentioned research paper by reducing the content of carbon and adding a specific amount of inexpensive phosphorus.

Another object of the invention is to provide a cold rolled steel which has higher yield strength, tensile strength and % elongation than the steel disclosed in U.S. Pat. No. 4.561,910 by intercritical annealing the steel, which is previously hot rolled and cold rolled. The phosphorus used in the present invention improves the formation of retained austenite while the phosphorus in the steel of the U.S. patent enhances the formation of martensite. The structure of the steel of the present invention contains more than 8% by volume of retained austenite.

Still another object of the invention is to provide a cold rolled annealed steel with a structure having ferrite, retained austenite, and martensite or bainite, the percentage of the retained austenite being more than 8%, and the sheet has a good weldability, a tensile strength of more than 70kgf/sq.mm and a valve of TS X EL (the product of the elongation and the tensile strength) which is greater than 2400kgf/sq.mm %.

According to the present invention, a low carbon steel composition, which consists of 0.08–0.25% by weight of carbon, 0.3–2.0% by weight of silicon, 0.6–1.8% by weight of manganese, 0.04–0.20% by weight of phosphorus, less than 0.10% by weight of aluminum, balance iron and unavoidable impurities, is hot rolled under a specific condition, then cold rolled and subjected to an intercritical annealing followed by isothermal holding at bainite transformation temperature region and then air cooled. If necessary, less than 0.01% by weight of boron may be added to the composition.

Specifically speaking, the slab obtained from the above composition is hot rolled under the condition that the coiling temperature is less than 600 deg C., and then cold rolled with a reduction of 75% in thickness. Afterwards, the cold rolled steel is heated for 1–10 min at a temperature (Ac1+10) deg C. - (Ac3-10) deg C., then cooled at a rate greater than 50 deg C./sec to a temperature 350–500 deg C. with a holding period of 1–10 min at that temperature before air-cooling.

Since the cooling rate greater than 50 deg C./sec is sufficient in the heat treatment, the present invention has an advantage in that a roller quenching process which is cheaper than the water quenching process can be used effectively for the purpose of achieving a high strength low carbon steel.

The reasons for limiting the component elements in the present invention is described as follows:

1. Carbon

To achieve a high strength, the carbon content is preferably not less than 0.08 by weight. On the other hand, to get more amount of retained austenite after heat treatment, the carbon centent is preferably more than 0.10% by weight. However, when the carbon content is greater than o.25%, it adversely affects the weldability. Accordingly, the carbon content is limited in a range from 0.08% to 0.25% by weight. The weldability of a steel can be determined by estimating the value of carbon equivalent (Ceq) which can be expressed as follows:

$$Ceq = C + Si/24 + Mn/6$$

Generally, the weldability for spot welding is considered to be good when the value of Ceq is less than 0.4%. The carbon content limited according to the present invention contributes to a Ceq value lower than or not much higher than 0.4%.

2. Silicon

Silicon has a deoxidation effect and a solid solution hardening effect. Experiments were conducted to investigate the effect of silicon and phosphorus on the amount of retained austenite. FIG. 1 shows the results of the experiments in which 0.15% by weight of carbon, 1.5% by weight of manganese are used and the amount of phosphorus and silicon are varied from 0 to 0.2% and from 0.3% to 2,0% by weight respectively. The steels formed from these composition were hot rolled until 950 deg C., coiled at 500 deg C. and cold rolled with 75% reduction in thickness. Then, the cold-rolleded steel is heated at 800 deg C. for 2.5 min, cooled rapidly to 450 deg C. in a salt bath and is held at that temperature for 5 minites and finally air cooled. It is found that, when phosphorus and silicon contents are respectively 0.04% and 0.3% by weight, more than 8% by volume of retained austenite was obtained. This is because, when the silicon centent is more than 0.3%, it accelerates the transformation of ferrite which promotes the diffusion of carbon into the gamma phase, thereby increasing the stability of the gamma phase and the amount of austenite. However, when the silicon content is greater than 2.0, the weldability is adversely affected. Accordingly, the silicon content is limited in the range of 0.3–2.0% by weight.

3. Manganese

Figure 2:
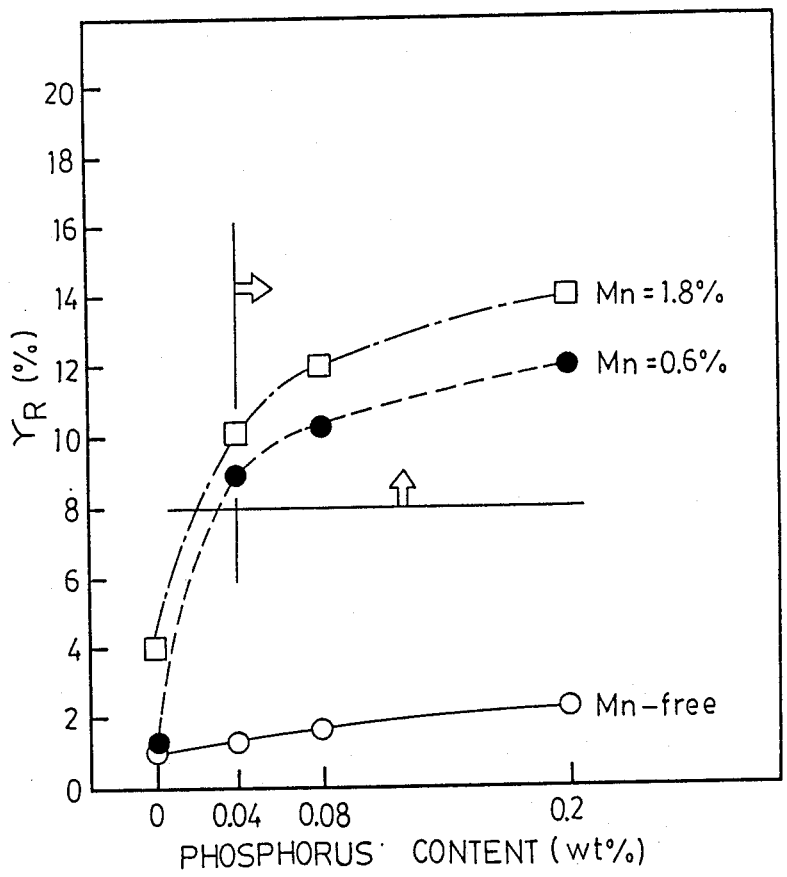

FIG. 2 shows the results of the experiment in which 0.15% by weight of carbon and 0.5% by weight of silicon are used, and the contents of manganese and phosphorus are varied respectively from 0–1.8% by weight and from 0 to 0.2% by weight. It is found that, when manganese content and phosphorus content are respectively greater than 0.6% and 0.04%, more than 8% by volume of retained austenite is obtained. This is because cemenite contained manganese in an amount higher than that in the matrix when phosphorus is added, thereby increasing the stability of austenite during heat treatment. This effect is operative when the manganese content is higher than 0.6% by weight. However, manganese content greater than 1.8% by weight raises the hardenability of the steel, thereby reducing the amount of the retained austenite. Therefore, the manganese content is limited in a range of 0.6%–1.8% by weight.

4. Phosphorus

From the results shown in FIGS. 1 and 2, it is also found that, when the phosphorus content is greater than 0.04, the amount of the retained austenite increases because of the accelerated migration of carbon into the gamma phase due to the transformation of ferrite as in the case of silicon. When the phosphorus content is greater than 0.20, the deterioration in ductility in the steel occurs due to the segregation of phosphorus to the grain boundaries. Therefore, the phosphorus content is limited in a range of 0.04–0.20% by weight.

5. Aluminum

Aluminum is used for the purpose of deoxidation. The content of aluminum is limited to less than 0.10% by weight since a content greater than 0.10% adversely affected the properties of the steel surface.

6. Boron

Boron may be added in an amount of less than 0.01% when it is necessary to surpress the problem of deterioration in ductility that may be created due to the addition of phosphorus.

Figure 3:
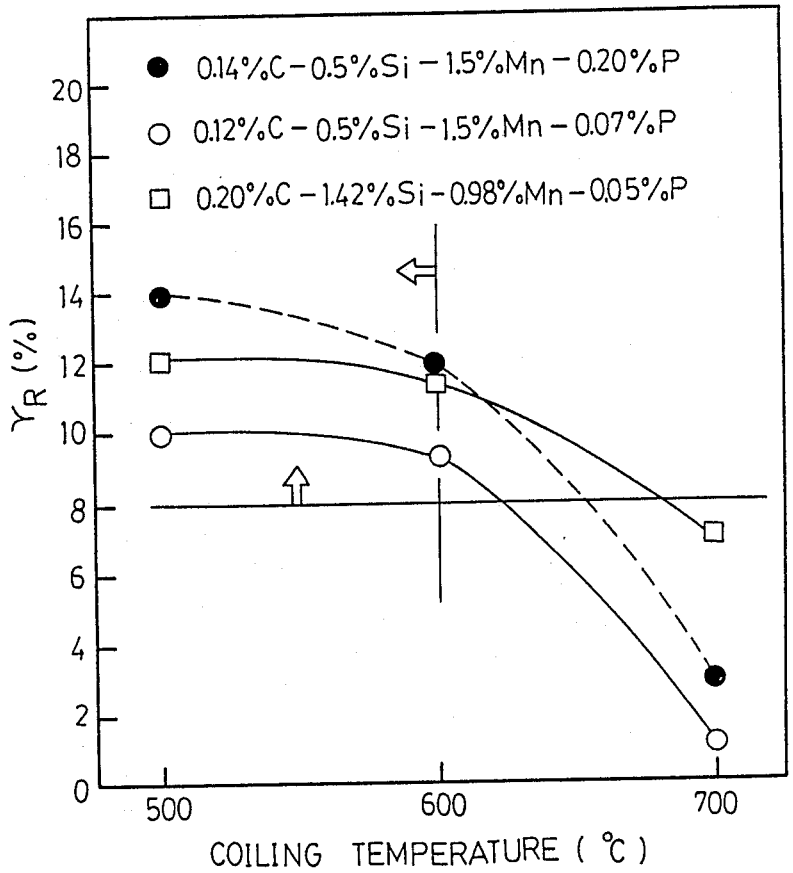

According to the present invention, the temperature at which the hot rolled steel is coiled is important for achieving a high strength low carbon steel. It is found that, when the coiling temperature after hot rolling is lower than 600 deg C., submicron size cementite particles were uniformly distributed in the matrix, and after heat treatment, the retained austenite can not only be stabilized but also be uniformly distributed in the matrix, thereby obtaining an excellent combination of high strength and high ductility. On the contrary, if the coiling temperature is higher than 600 deg C., the size of cemenititte will be coarsened at the grain boundaries and therefore the amount of the retained austenite will be reduced after cold rolling and heat-treatment because the cementite is difficult to be dissolved. From FIG. 3, it can be noted that the amount of the retained austenite increases when the coiling temperature is lower than 600 deg C.

Figure 4:
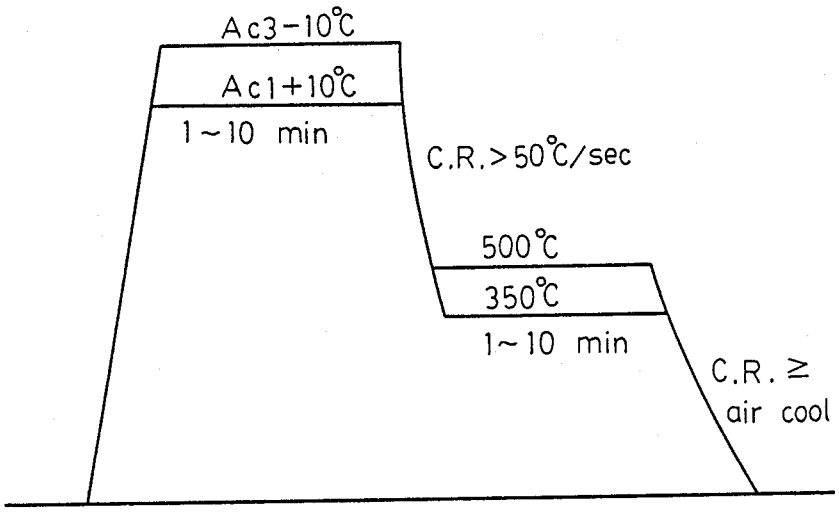

After cold rolling, the steel is annealed for a period at a temperature of the gamma+alpha phase, preferably at a temperature of (Ac1+10) deg C. - (Ac310) deg C., where Ac1 is the temperature at which austenite starts to form, and Ac3 is the temperature at which the transformation of austenite is complete. Then, the intercritically annealed steel is directly cooled to a temperature near and above Ms (the temperature at which martensite starts to form) to effect the transformation to bainite, and air-cooled to obtain a structure containing ferrite, retained austenite and bainite with or without a small amount of martensite. Table 1 shows that, when the holding period at the annealing temperature is longer than 1 min and the cooling rate is higher than 50 deg C./sec, the amount of retained austenite is increased, and when lower than 1 min and 50 deg C./sec respectively, the amount of retained austenite is reduced. During cooling after intercritical annealing and isothermal holding at bainite transformation temperature region, the carbon content in the austenite increases due to the transformation of ferrite and bainite. The holding period at bainite transformation temperature region is limited to 1–10 min since the concentration of carbon will be insufficient when the holding period is less than 1 min, and all austenite will be transformed to bainite when the holding period is more than 10 min. The heat treatment is illustrated diagrammetically in FIG. 4.

TABLE 1

Effect of Intercritical Annealing Time and Cooling Rate on the Amount of Retained Austenite (%)

| Retained austenite (%) | | Intercritical annealing time at 800° C. 0.5 | 1 | 5 | 10 |
|---|---|---|---|---|---|
| Cooling rate after annealing (°C./sec) | 20 | 1 | 1 | 2 | 1 |
| | 50 | 1 | 11 | 13 | 12 |
| | 200 | 2 | 12 | 14 | 12 |

The following examples are given for the purpose of illustration of this invention and are not intended as limitations thereof.

Steel samples having compositions shown in the following Table 2 were made into slabs.

TABLE 2

| Sample No. | Chemical composition (wt %) C | Si | Mn | P | S | | Cr |
|---|---|---|---|---|---|---|---|
| | | | Steel of the present invention | | | | |
| 1 | 0.20 | 1.42 | 0.98 | 0.05 | 0.006 | | 0.42 |
| 2 | 0.12 | 0.53 | 1.58 | 0.07 | 0.005 | | 0.41 |
| 3 | 0.14 | 0.53 | 1.57 | 0.20 | 0.006 | | 0.42 |
| | | | | Comparative steel | | | |
| 4 | 0.18 | 0.45 | 1.33 | 0.007 | 0.007 | | 0.42 |
| 5 | 0.12 | 1.4 | 1.63 | 0.015 | 0.009 | 0.34 | 0.45 |
| 6. | 0.12 | 1.4 | 1.63 | 0.015 | 0.009 | 0.34 | 0.45 |
| 7. | 0.29 | 0.18 | 0.48 | 0.012 | 0.009 | | 0.38 |
| 8. | 0.50 | 0.07 | 0.8 | 0.017 | 0.011 | | 0.64 |

Each slab was heated up to 1250 deg C., then hot rolled into a coil and cold rolled with a reduction of 75% in thickness, under the following hot rolling condition:

| | |
|---|---|
| Finishing hot rolling temperature | 950° C. |
| Coiling temperature: | 500° C. |
| Average cooling rate from beginning of cooling after hot rolling to coiling | 15° C./sec |

The above cold rolled steel samples are then heat treated under the following intercritical annealing conditions shown in Table 3.

TABLE 3

| Sample No. | Annealing time (min) | Annealing temp. | 1st cooling rate | Temp. after 1st cooling | Holding time min | 2nd cooling rate | Temp. after 2nd cooling | Final cooling |
|---|---|---|---|---|---|---|---|---|
| 1 | 5 | 800° C. | 60° C./sec | 440° C. | 2 | — | — | air cooling |
| 2 | 2.5 | 800° C. | 120° C./sec | 450° C. | 5 | — | — | air cooling |
| 3. | same as above | | | | | | | |
| 4. | same as above | | | | | | | |
| 5. | 3 | 750° C. | water quench | 400° C. | 5 | — | — | air cooling |
| 6. | 10 | 750° C. | water quench | 400° C. | 3 | — | — | air cooling |
| 7. | 1 | 865° C. | 5° C./sec | 730° C. | — | 45° C./sec | 400° C.(3 min) | air cooling |
| 8. | 1 | 905° C. | 5° C./sec | 680° C. | — | 100° C./sec | 250° C.(3 min) | air cooling |

The mechanical properties and microstructures of the samples 1 to 8 are shown in Table 4. It can be seen that the Samples 1, 2 and 3 has a tensile strength greater than 70kgf/sq.mm and the TS X EL value thereof is greater than 2400kgf/sq.mm. %. The phosphorus content in Comparative Sample 4 is less than the amount required by the present invention, and therefore only a little amount of retained austenite, about 1%, is present in the steel and the mechanical properties thereof are poorer than that of Samples 1, 2 and 3. The heat treatments of comparative Samples 5 and 6 are different from the present invention and no retained austenite is present in the steel. The strength of Samples 7 and 8 increases as the carbon content increases but the ductility thereof is poor as there is no retained austenite.

Figure 5:
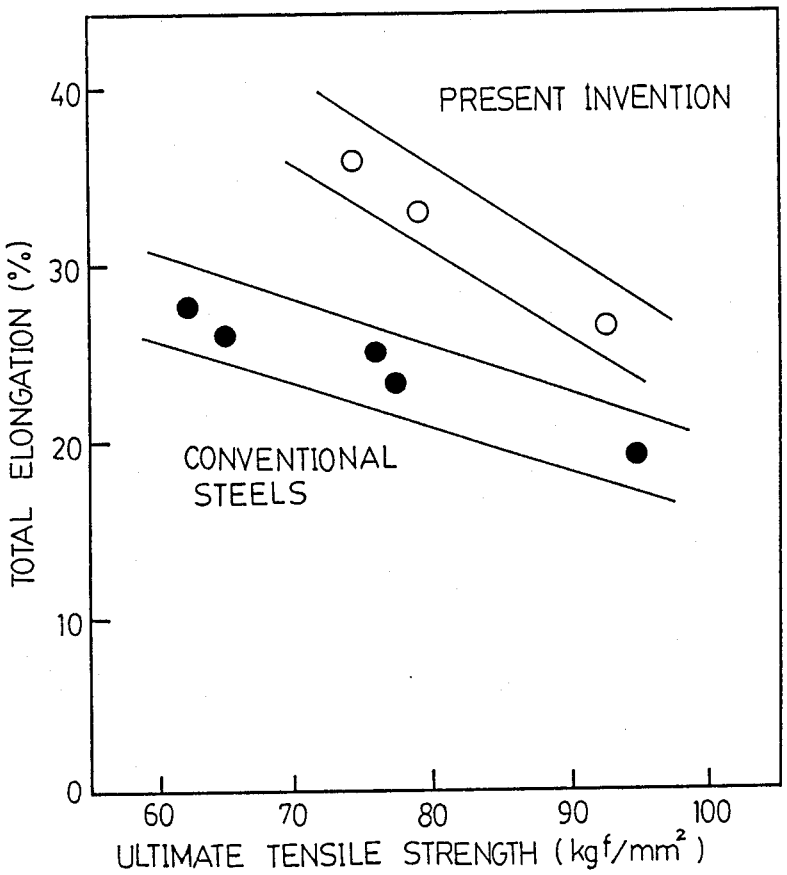

FIG. 5 shows the relation between the tensile strength and total elongation. It is apparent that the steels of the present invention have very good combination of strength and ductility.

TABLE 4

| Sample No. | Mechanical Properties and Microstructures Yield strength kgf/mm² | Tensile Strength kgf/mm² | Total Elongation % | TS X EL kgf/mm². % | Retained Austenite vol. % | Microstructure |
|---|---|---|---|---|---|---|
| | | | Steel of the present invention | | | |
| 1. | 49 | 79 | 33 | 2610 | 12 | F + $\nu_R$ + B |
| 2 | 46 | 75 | 36 | 2700 | 10 | F + $\nu_R$ + B |
| 3 | 51 | 93 | 26 | 2420 | 14 | F + $\nu_R$ + B |
| | | | Comparative Steel | | | |
| 4 | 52 | 65 | 26 | 1690 | 0 | F + B |
| 5 | 52 | 63 | 27 | 1700 | 0 | F + M |
| 6 | 58 | 78 | 23 | 1790 | 0 | F + M |
| 7 | 65 | 76 | 25 | 1900 | 0 | F + B |
| 8 | 80 | 95 | 19 | 1800 | 0 | F + B |

F: ferrite;
$\nu_R$: retained austenite;
B: bainite;
M: martensite

What I claim is:

1. A method of producing a retained austenite containing high strength, high ductility, cold rolled steel sheet comprising:

producing a molten steel having a composition of 0.08–0.25% by weight of carbon, 0.3–2.0% by weight of silicon, 0.6–18% by weight of manganese, 0.04–0.20% by weight of phosphorus, less than 0.10% by weight of aluminum, less than 0.01% by weight of boron, unavoidable impurities and balance iron;

forming the molten steel into a slab by a conventional method;

subjecting the slab to a hot rolling under the condition that the coiling temperature is less than 600° C.

subjecting the hot rolled steel to a cold rolling under the condition that the reduction rate is 50–90%;

heating the cold rolled steel for 1–10 minutes to a temperature (Ac1+10)° C. to (Ac3-10)° C., where Ac1 is the temperature at which austenite starts to form, and Ac3 is the temperature at which the transformation of austenite is complete;

cooling the intercritically annealed steel at a rate greater than 50° C./sec down to a temperature 350°–500° C.;

keeping the steel for 1–10 minutes at 350°–500 ° C.; and air cooling the steel;

whereby the resulting cold rolled annealed steel sheet has a microstructure consisting of ferrite and bainite and retained austenite, the volume fraction of said retained austenite being at least 8 percent.

* * * * *